United States Patent [19]

Onodera et al.

[11] 4,192,732

[45] Mar. 11, 1980

[54] RECOVERY AND RECYCLE OF DEWAXING AID

[75] Inventors: Takashi Onodera, Urawa; Kikuji Komine, Tokorozawa; Fumio Ohashi, Ohi, all of Japan

[73] Assignee: Toa Nenryo Kogyo Kabushiki Kaisha, Tokyo, Japan

[21] Appl. No.: 926,859

[22] Filed: Jul. 21, 1978

[51] Int. Cl.[2] ..... C10G 43/06; C10G 43/08

[52] U.S. Cl. ..... 208/33; 208/38

[58] Field of Search ..... 208/24, 33, 38

[56] References Cited

U.S. PATENT DOCUMENTS

| | | | |
|---|---|---|---|
| 1,715,670 | 6/1929 | Olsen | 208/33 |
| 1,921,860 | 8/1933 | Bahlke | 208/24 |
| 2,064,506 | 12/1936 | Towne | 208/33 |
| 2,248,498 | 7/1941 | Gross et al. | 208/33 |
| 2,612,465 | 9/1952 | Kiersted et al. | 208/24 |

*Primary Examiner*—Herbert Levine

*Attorney, Agent, or Firm*—Edward M. Corcoran

[57] ABSTRACT

Dewaxing aid used in a solvent dewaxing process is recovered in wax bottoms from slack wax by vacuum distilling the slack wax to about 5–10 wt. % bottoms at a temperature no greater than about 320° C. The dewaxing aid-containing wax bottoms is recycled back into the dewaxing process by adding same to the wax-containing oil feed in an amount ranging from about 0.5–5 wt. %. This has been found to be particularly advantageous when the dewaxing aid is an α-olefin copolymer, a chlorinated paraffin/naphthalene condensation product and mixture thereof because of their thermal stability.

14 Claims, 2 Drawing Figures

RECOVERY AND RECYCLE OF DEWAXING AID

BACKGROUND OF THE INVENTION

Field of the Invention

This invention relates to a process for recovering dewaxing aids. More particularly, this invention relates to an improvement in a process for solvent dewaxing a wax-containing hydrocarbon oil containing a dewaxing aid wherein said process produces wax containing said dewaxing aid, the improvement which comprises vacuum distilling said wax to recover a wax bottoms or residue containing said dewaxing aid and recycling said wax bottoms back into the dewaxing process. Still more particularly this invention relates to a process for recovering and recycling dewaxing aids comprising α-olefin copolymers, chlorinated paraffins/naphthalene condensation products and mixtures thereof by vacuum distilling slack wax containing said dewaxing aids produced via a solvent dewaxing process to about 5–10 wt.% wax bottoms at a temperature no greater than about 320° C. and then recycling the dewaxing aid-containing wax bottoms back into the solvent dewaxing process by adding same to the wax-containing oil feed in an amount ranging from about 0.5–5 wt.%.

Waxes contained in hydrocarbon oils such as lubricating oil fractions are generally removed by solvent dewaxing processes. As the dewaxing solvent, there are generally used low-boiling-point hydrocarbons such as propane, butane, pentane and hexane, and ketone/aromatic hydrocarbon mixtures such as methylethyl ketone/toluene and acetone/benzene. It is known that the treatment capacity of such solvent dewaxing process depends mainly on the filtration rate or efficiency at the filtering step subsequent to the chilling step, and the filtration rate is greatly influenced by the crystal structure of the wax to be separated. In propane dewaxing processes the waxy oil is chilled by the latent heat of evaporation of liquid propane which produces a so-called shock chilling effect causing the formation of fine wax crystals which result in a relatively slow rate of filtration of the dewaxed oil from the wax crystals because of the tendency of the wax crystals to clog the pores of the wax filter cloth in the wax filters and form a dense, relatively impervious mat.

As means for overcoming the foregoing disadvantages, substances capable of changing the size and shape of wax crystals are used so as to facilitate and improve the separation and filtration of waxes at the dewaxing step. These substances are called dewaxing aids and are incorporated together with a solvent into a wax-containing oil. Known dewaxing aids include a chlorinated paraffin/naphthalene condensate sold as a pour point depressant under the tradename of Paraflow, mixtures of an ethylene-vinyl acetate copolymer and a copolymer of unsaturated esters of aliphatic alcohols with acrylic acid or methacrylic acid, α-olefin copolymers and the like.

The amount of dewaxing aid added to a wax-containing oil is determined after due consideration of such factors as properties (the wax content and viscosity) of the wax-containing oil, the properties of the dewaxing aid, the chilling rate and the filtration rate, but in general, the amount of the dewaxing aid used will range from about 0.01 to 5.0 wt.% of the waxy oil.

However, it has not been clarified whether the dewaxing aid added to the wax-containing oil for attaining the above effect is left in the separated wax component or in the dewaxed oil after the dewaxing treatment. Accordingly, a method for separating the dewaxing aid effectively has not been established, and at the present, the added dewaxing aid is consumed away. Only with respect to the case where an aromatic polymeric substance such as Paraflow is used as the dewaxing aid, there has been proposed a process in which an alcohol is incorporated in slack waxes to extract and to precipitate the polymeric substance contained therein and a process in which slack waxes are passed through an adsorbing bed to separate the polymeric substance by adsorption. These processes, however, are defective in that the extracting solvent or adsorbent must be generated, the process steps are complicated and there is a risk of loss of the dewaxing aid.

As a result of various investigations, we found that the dewaxing aid added cocrystallizes with the wax when the wax is precipitated from a wax-containing oil at the chilling step to thereby attain the dewaxing performance, and the effective ingredient of the dewaxing aid is completely left in the separated slack waxes.

Based on this finding, we furthered our researches with a view to developing a process in which the effective ingredient of the dewaxing aid can be recovered substantially completely from separated slack waxes and the recovered effective ingredient is added to the wax-containing oil feed again to conduct the dewaxing step repeatedly.

SUMMARY OF THE INVENTION

A process has now been discovered in which the dewaxing aid can be recovered by vacuum distilling off most of the slack wax under conditions of temperature such that the dewaxing aid is not decomposed. The dewaxing aid can be repeatedly recycled back into the dewaxing operation and subsequently recovered. More specifically, the present invention is an improvement in a process for solvent dewaxing a wax-containing hydrocarbon oil containing a dewaxing aid to produce wax containing said dewaxing aid, wherein the improvement comprises vacuum distilling said wax to recover a wax residue or bottoms containing said dewaxing aid and recycling same back into the dewaxing process. The dewaxing aid recovered from the wax via the process of this invention, has been found not to suffer any reduction in performance as a dewaxing aid. Thus, the present invention permits efficient recovery of the dewaxing aid without using an extraction agent or absorbent which would complicate the dewaxing process and involve additional handling problems.

An essential feature of the present invention resides in vacuum distilling the dewaxing aid-containing wax and the process is characterized in that the distillation zone is operated under conditions of temperature and pressure such that thermal decomposition of the dewaxing aid is avoided. The operating conditions of the vacuum distillation zone must also be controlled so that the dewaxing aid in the wax is not distilled out together with the waxy components so that the wax is concentrated in the residue or bottoms to such an extent that the amount of residue or bottoms is reduced to an easy-handling level and the residue contains the dewaxing aid at a concentration equivalent to the initial amount of dewaxing aid added into the dewaxing process. In order to achieve these results, it is preferred to operate the vacuum distillation zone so that the wax component is distilled out in an amount corresponding to about from 50 to 99.5 wt.% and preferably from about 85 to about 99 wt.% of the wax fed to the vacuum distillation zone.

FIG. 1 illustrates the wt.% dewaxing aid present in the wax bottoms from the vacuum distillation zone as a function of the amount of wax distilled base on the feed to said zone and also illustrates the wt.% of wax bottoms added to the waxy oil feed as a function of the amount of wax distilled from the wax fed into said zone. It is immediately apparent from FIG. 1 that the greater the amount of wax distilled off in the zone, the more concentrated is the dewaxing aid in the wax bottoms and the smaller the amount of dewaxing aid containing wax bottoms that is necessary to be recycled and mixed with the waxy oil feed.

It has been found that certain dewaxing aids such as a vinyl acetate-olefin copolymer and a copolymer of esters of aliphatic alcohols with acrylic acid or methacrylic acid, tend to decompose at temperatures higher than 200° C. but a chlorinated paraffin-naphthalate condensate and an α-olefin copolymer, especially one composed of an α-olefin having 4 to 30 carbon atoms and having a number average molecular weight of 5,000 to 200,000, are stable at about 320° C. or a higher temperature. In the present invention, it is preferred to use dewaxing aids of the latter type.

In order to minimize thermal decomposition of the dewaxing aid and maximize the concentration of the dewaxing aid in the slack wax, it is preferred that the vacuum distillation be carried out under a pressure of up to about 100 mmHg, especially from about 1 to 50 mmHg, so that the temperature at the bottom of the column, i.e., the temperature of the bottoms composed of the dewaxing aid and residual slack wax, is lower than about 320° C., it is preferred that the temperature range between about 200° to 300° C. and particularly from about 250° to 300° C. Further, distillation may be conducted in the presence of steam.

The residue or bottoms left after distilling off most of the wax, which contains the majority of the dewaxing aid, is taken out from the bottom of the distillation column and stored in an intermediate storage tank so as to cope with variations of the dewaxing conditions which will probably take place during the continuous operation. By adjusting the amount of the wax distilled off to a level corresponding to from about 50 to 99.5 wt.% of the slack wax feed as pointed out hereinbefore, there can be attained another effect of facilitating transportation of the dewaxing aid and wax residue.

The so-recovered dewaxing aid is recycled and added to the wax-containing oil feed through an intermediate storage tank, and the amount of the so-recovered dewaxing aid added will be from about 0.1 to 12 wt.% and preferably from about 0.5 to 5 wt.%. This amount added depends, of course, on the amount of dewaxing aid in the bottoms and will generally range from about 50 to 100 wt.% of the distillation residue or bottoms.

Any waxy petroleum oil stock or distillate fraction thereof may be dewaxed employing the dewaxing aid of this invention. Illustrative but nonlimiting examples of such stocks are (a) distillate fractions that have a boiling range within the broad range of from about 500° to 1300° F., with preferred stocks including lubricating oil and specialty oil fractions boiling within the range of from between about 550° and 1200° F., and (b) bright stocks and deasphalted resids having an initial boiling point above about 800° F. Additionally, any of these feeds may be hydrocracked prior to distilling, or deasphalting. These may come from any source such as paraffinic crudes obtained from Aramco, Kuwait, panhandle, North Louisiana, etc., naphthenic crudes, such as Tia Juana, coastal crudes, etc., as well as the relatively heavy feedstocks such as brightstocks having a boiling range of 1050+° F. and synthetic feedstocks derived from Athabasca tar sands or coal, etc. This invention has been found to be particularly suited for dewaxing a distillate fraction having a boiling range of up to 1000° F.

The dewaxing solvent that is used in the present invention is not particularly critical. Namely, any of solvents having a selective dissolving property to the oil component of a wax-containing oil at a dewaxing low temperature can be used. For example, there may be used at least one member selected from linear hydrocarbons having 2 to 10 carbon atoms in the molecule, such as ethane, propane, butane, pentane, hexane, octane, ethylene, propylene, butylene, pentene, hexene and octene, or a mixture of at least one member selected from ketones such as acetone, dimethyl ketone, methylethyl ketone, methylpropyl ketone and methylisobutyl ketone with at least one member selected from aromatic hydrocarbons such as benzene and toluene, e.g., methylethyl ketone/toluene or methylisobutyl ketone/toluene. Further, N-alkylpyrrolidones, such as N-methylpyrrolidone and N-ethylpyrrolidone may be used as the dewaxing solvent. Still further, an autorefrigerative mixed solvent such as a mixture of a linear hydrocarbon such as mentioned above with a ketone such as acetone can be used as the dewaxing solvent. Solvents preferred for practicing the process of the present invention include propane, other autorefrigerative solvents, and a mixture of a ketone and an aromatic hydrocarbon.

PREFERRED EMBODIMENT

Figure 1:
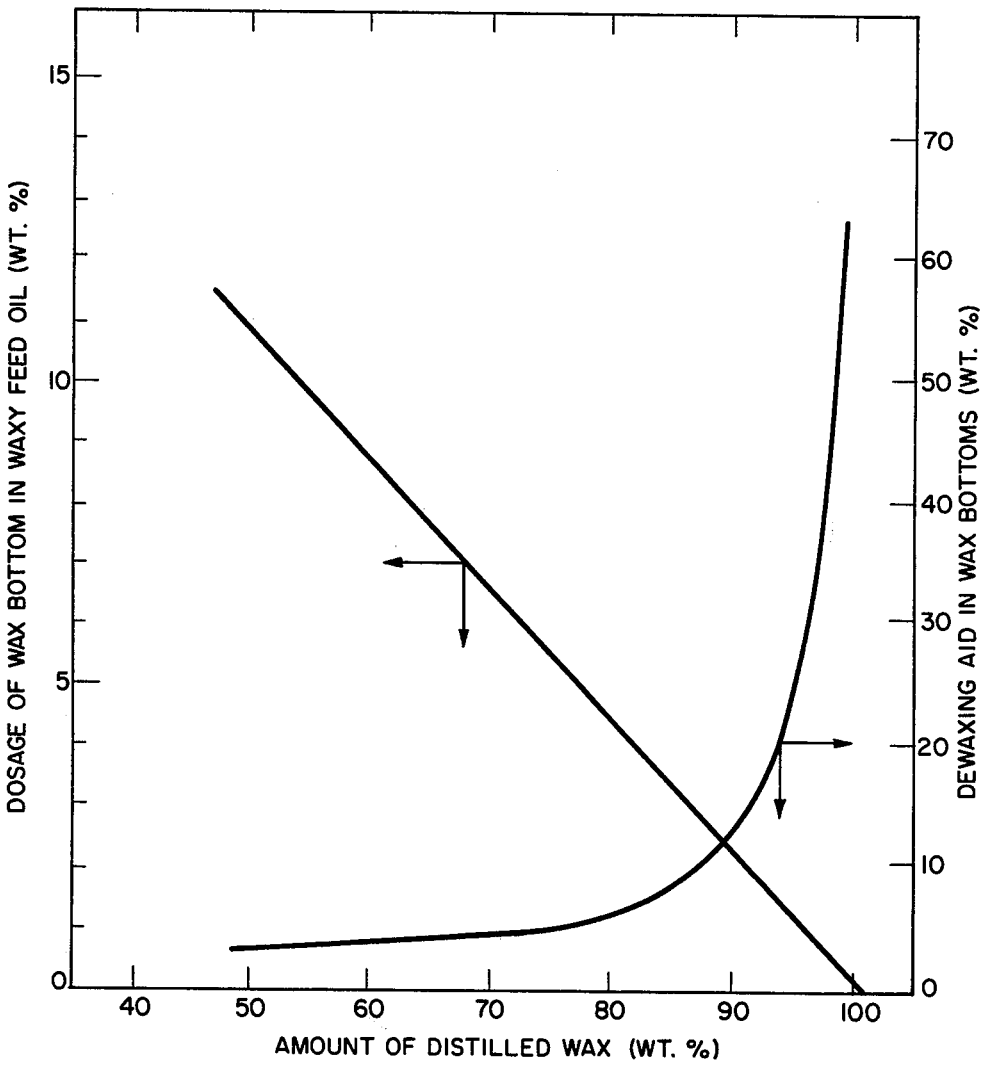
FIG. 1 illustrates both the amount of dewaxing aid in the wax bottoms and the bottoms dosage required for the waxy oil feed required to achieve the proper level of dewaxing aid in said waxy oil feed, as a function of the amount of slack wax distilled off in the vacuum distillation zone based on the amount slack wax feed fed to said zone.
Figure 2:
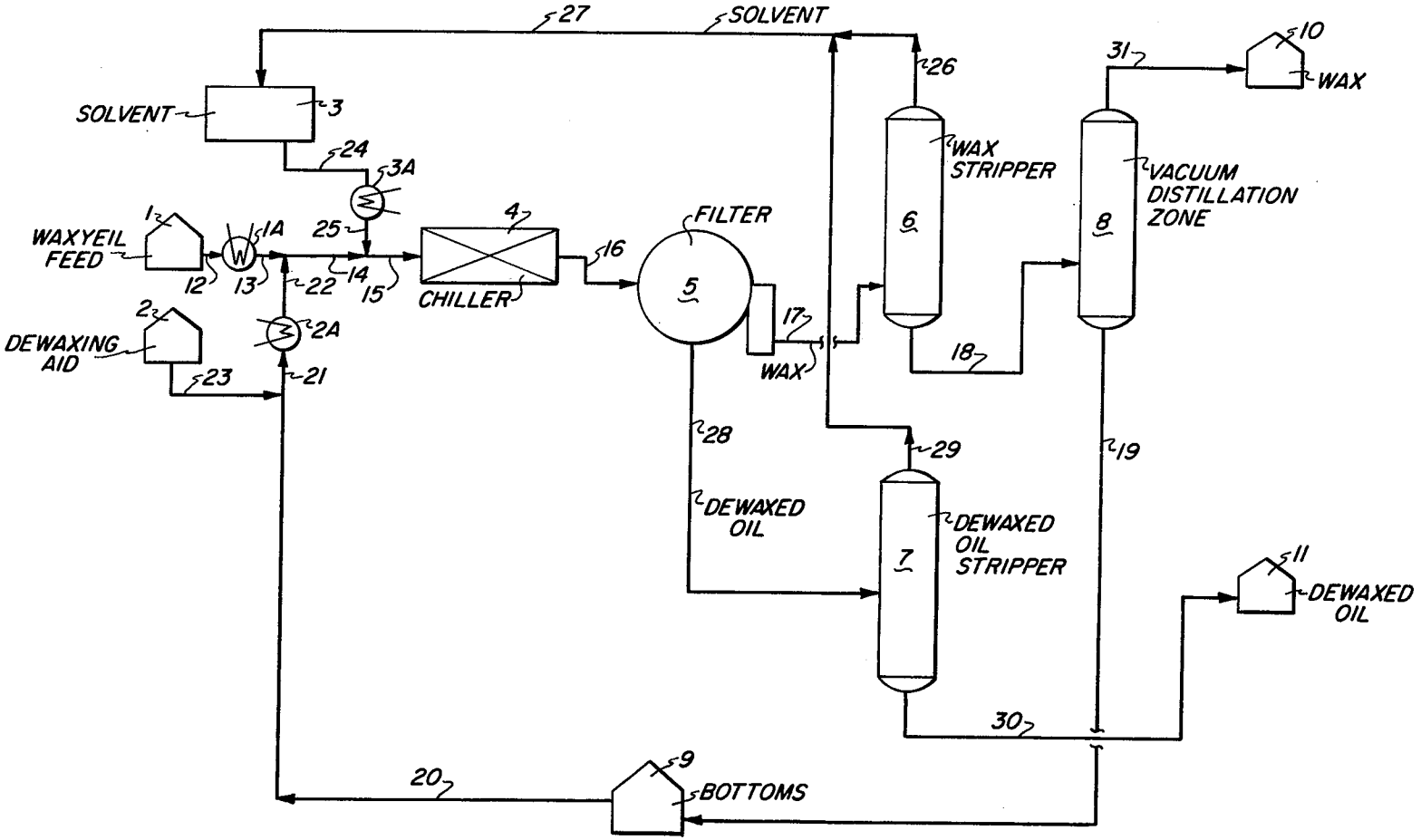
FIG. 2 is a flow diagram of a preferred embodiment of the process of this invention.

Referring to FIG. 2, a waxy petroleum oil feed, dewaxing aid and propane or other suitable dewaxing solvent are fed from storage tanks 1, 2 and 3, respectively, through heat exchangers 1*a*, 2*a* and 3*a* via lines 12, 23 and 24 respectively, wherein they are heated, subsequently mixed, stirred and introduced into chiller 4 via lines 13, 22, 25, 14 and line 15 wherein the mixture of waxy oil, dewaxing solvent and dewaxing aid is chilled to a temperature of from about −30° to about −40° C. to precipitate solid wax crystals from the oil, thereby forming a slurry comprising solid wax particles containing dewaxing aid and a mixture of dewaxed oil and dewaxing solvent. The slurry produced in chiller 4 is fed via line 16 to rotary wax filter 5 wherein the solid wax particles are separated from the dewaxed oil and solvent. The filtrate comprising dewaxed oil and solvent is passed from filter 5 to stripper 7 via line 28. In stripper 7 the solvent is separated from the oil and recycled back to solvent storage 3 via lines 29 and 27. The solvent-free oil is passed to dewaxed oil storage 11 via line 30. The solid wax is caused to adhere to a rotating filter cloth in filter 5 as a wax cake, is washed by a wash solvent and then the wax cake is shaved off the filter, heated to about 200° C. by means not shown and fed via line 17 to wax stripper 6. Wax stripper 6 is a vacuum distillation column which removes residual dewaxing solvent from the wax and passes the solvent back to solvent storage 3 via lines 26 and 27. The solvent-free wax is then taken from the bottom of wax stripper 6 and fed via line 18 to vacuum distillation zone 8. Vacuum distillation zone 8 is a vacuum distillation column wherein most of the wax is distilled off and passed via line 31 to wax storage 10 while a small residue or wax-bottoms containing the dewaxing aid is removed via line 19 and passed to bottoms storage 9. Vacuum distillation column 8 is operated at a temperature of up to about 320° C. at a pressure of about 100 mmHg or less, preferably from about 1 to about 50 mmHg, whereby from about 50 to about 99.5 by weight of the solvent-free wax fed to zone 8 is distilled out and removed via line 31. The exact conditions used in zone 8 are, of course, a function of the dewaxing aid used, the oily feed and the dewaxing conditions. The waxy residue or bottoms is then recycled back into the dewaxing process via lines 20, 21, heat exchanger 2*a* and line 22 wherein it is added to and mixed with the waxy oil feed in an amount ranging from about 0.1 to about 12 wt.%. Thus, the dewaxing operation is then repeated and the process of recycling the dewaxing aid goes on indefinitely.

Fresh dewaxing aid is supplied from storage 2 in order to compensate for loss of dewaxing aid decomposed and deactivated in the process due to deviations in the operating conditions of the vacuum distillation zone 8, or as a result of being consumed in other parts of the dewaxing operation.

The invention will be further understood by reference to the following Examples.

EXAMPLE 1

Two hundred fifty grams of a light lubricating oil fraction having a wax content of 20.1 wt.%. and a viscosity of 4.5 cst (measured at 98.9° C.) was charged in an autoclave with a dewaxing aid in an amount of 0.3 wt.%. of the oil feed and propane solvent in an amount 4 times the amount of the oil feed by volume. The mixture was heated to about 60° C. to form a homogeneous solution of the contents, and the solution was externally chilled to −40° C. under agitation at a cooling rate of 2° C./minute. After the chilling operation, the oil-wax mixture (slurry) was introduced at the above temperature to a wax filter where filtration was conducted at a pressure differential of 600 mmHg. The recovered wax crystals were solvent washed at the chilling temperature. The wax crystals were then dried, melted and subjected to atmospheric distillation to evaporate the solvent to obtain the slack wax as the residue. The slack wax was then subjected to vacuum distillation under 2 mmHg (absolute pressure) at 278° C. to distill off wax in an amount corresponding to about 84 wt.% of the supplied slack wax and recover the polymeric dewaxing aid as part of the distillation residue or bottoms.

All of the so-obtained residue was added at the second cycle of the dewaxing step as the dewaxing aid (no fresh dewaxing aid was added). At the second cycle of the dewaxing step, the amounts of the wax-containing oil feed and solvent were the same as those at the first cycle, and the heating, melting, chilling and filtering procedures were the same as those adopted at the first cycle. The third and fourth cycles of the dewaxing steps were conducted in the same manner.

As will be apparent from the results shown in Table I, the dewaxing performance attained at the second and subsequent cycles were the same as those attained at the first cycle.

TABLE I

| Dewaxing Results | First Cycle | Second Cycle | Third Cycle | Fourth Cycle |
|---|---|---|---|---|
| Amount (wt. %) of dewaxing aid | 0.3 | 2.4* | 2.4 | 1.8 |
| Filtration rate (gal/ft$^2$/hr) | 16.3 | 14.5 | 14.4 | 14.6 |
| Yield (wt. %) of dewaxed oil | 78.4 | 78.9 | 78.6 | 78.9 |
| Amount (g) of recovered slack wax | 54.0 | 58.5 | 59.4 | 58.6 |
| Recovery of Dewaxing Aid by Vacuum Distillation | | | | |
| Amount (wt. %) of distilled slack wax | 89.3 | 89.9 | 92.4 | 91.3 |
| Amount (wt. %) of residue (slack wax and dewaxing aid) | 10.7 | 10.1 | 7.6 | 8.7 |
| Amount (g) of residue (slack wax and dewaxing aid) | 5.8 | 5.9 | 4.5 | 5.1 |

*all of the vacuum distillation residue at the first cycle was added (the same holds good at the subsequent cycles)
Dewaxing Aid Used:
(A) α-olefin copolymer synthesized from 38% by weight of hexene, 26% by weight of hexadecene and 15% by weight of eicosene and having a number average molecular weight of 30,000; used in the form of a solution having a polymer concentration of 0.20% by weight
(B) naphthalene-chlorinated paraffin condensate (manufactured and sold under tradename Paraflow 149 by Exxon Chemical Co.)
Composition: (A)/(B) = 2/1

COMPARATIVE EXAMPLE 1

Solvent dewaxing and recovery of the dewaxing aid were conducted in the same manner as described in Example 1 except that the vacuum distillation of the slack wax was carried out at 350° C. under 20 mmHg. Obtained results are shown in Table II from which it will readily be understood that the dewaxing performance was gradually reduced.

TABLE II

| Dewaxing Results | First Cycle | Second Cycle | Third Cycle | Fourth Cycle |
|---|---|---|---|---|
| Amount (wt. %) of dewaxing aid | 0.3 | 2.3 | 2.2 | 2.3 |
| Filtration rate (gal/ft$^2$/hr) | 16.0 | 10.2 | 7.8 | 5.0 |
| Yield (wt. %) of dewaxed oil | 78.3 | 77.3 | 75.1 | 71.5 |
| Amount (g) of recovered slack wax | 54.2 | 57.0 | 63.0 | 72.3 |

TABLE II-continued

| Recovery of Dewaxing Aid by Vacuum Distillation | | | | |
|---|---|---|---|---|
| Amount (wt. %) of distilled slack wax | 89.5 | 90.1 | 91.0 | — |
| Amount (wt. %) of residue (slack wax and dewaxing aid) | 10.5 | 9.9 | 9.0 | — |
| Amount (g) of residue (slack wax and dewaxing aid) | 5.7 | 5.6 | 5.7 | — |

COMPARATIVE EXAMPLE 2

Solvent dewaxing of the wax-containing oil feed and the vacuum distillation of the separated slack wax for recovery of the dewaxing aid were conducted in the same manner as described in Example 1 except for the following changes. The recovered dewaxing aid was added to the wax-containing oil feed again and was used repeatedly.

Dewaxing Aid Used:

Composition: $(C)/(D)=5/1$ (C): copolymer of esters of aliphatic alcohols with methacrylic acid having number average molecular weight of 300,000 as measured according to osmometric method and having starting ester composition of 55% by weight of $C_{12}$ ester, 15% by weight of $C_{14}$ ester, 10% by weight of $C_{16}$ ester and 20% by weight of $C_{18}$ ester (D): ethylene-vinyl acetate copolymer having number average molecular weight of 230,000 as measured according to light scattering method and having vinyl acetate content of 33% by weight Initial Amount of Supplied Dewaxing Aid: 0.2% by weight Wax-Containing Oil Feed: Medium lubricating oil having wax content of 15.1 wt.% and kinematic viscosity of 7.1 cst as measured at 98.1° C.

Vacuum Distillation: 2 mmHg, 279° C.

All of the dewaxing aid-containing residue obtained by the vacuum distillation was added to the wax-containing oil feed to be treated at the subsequent cycle of the dewaxing step.

Obtained results are shown in Table III from which it will readily be understood that the dewaxing performance was gradually reduced.

TABLE III

| Dewaxing Results | First Cycle | Second Cycle | Third Cycle | Fourth Cycle |
|---|---|---|---|---|
| Amount (wt. %) of dewaxing aid | 0.2 | 2.9* | 2.9 | 2.4 |
| Filtration rate (gal/ft$^2$/hr) | 15.1 | 10.3 | 8.4 | 5.0 |
| Yield (wt. %) of dewaxed oil | 80.1 | 75.3 | 69.1 | 65.0 |
| Amount (g) of recovered slack wax | 49.5 | 61.8 | 77.0 | 88.2 |
| Recovery of Dewaxing Aid by Vacuum Distillation | | | | |
| Amount (wt. %) of distilled slack wax | 85.5 | 87.9 | 92.2 | — |
| Amount (wt. %) of residue (slack wax and dewax. aid) | 14.5 | 12.0 | 7.8 | — |
| Amount (g) or residue (slack wax and dewaxing aid) | 7.2 | 7.5 | 6.0 | — |

*all of the vacuum distillation residue at the first cycle was added (the same holds good at the subsequent cycles)

EXAMPLE 2

Solvent dewaxing of a medium lubricating oil fraction having a viscosity of 12.2 cst as measured at 98.9° C. and a wax content of 19.8 wt.% was carried using a 1/1 mixed solvent of methylethyl ketone and toluene and the same dewaxing aid used in Example 1 (α-olefin copolymer/chlorinated paraffin-naphthalene condensate=2/1).

The dewaxing aid recovered by vacuum distillation of the separated slack wax was added to the wax-containing oil feed and used repeatedly for the dewaxing treatment. The dewaxing and vacuum distillation conditions were the same as those adopted in Example 1 except that the chilling temperature at the dewaxing step was −30° C. and the vacuum distillation was carried out at 293° C. and 0.3 mmHg.

Obtained results are shown in Table IV, from which it will readily be understood that the dewaxing performance was hardly changed among the first to fourth cycles.

Table IV

| Dewaxing Results | First Cycle | Second Cycle | Third Cycle | Fourth Cycle |
|---|---|---|---|---|
| Amount (wt. %) of dewaxing aid | 0.3 | 2.5 | 2.6 | 2.9 |
| Filtration rate (gal/ft$^2$/hr) | 13.4 | 12.1 | 12.1 | 12.4 |
| Yield (wt. %) of dewaxed oil | 79.1 | 79.4 | 79.1 | 79.3 |
| Amount (g) of recovered slack wax | 52.3 | 57.5 | 58.5 | 58.5 |
| Recovery of Dewaxing Aid by Vacuum Distillation | | | | |
| Amount (wt. %) of distilled slack wax | 88.0 | 88.7 | 87.6 | 89.7 |

Table IV-continued

| | | | | |
|---|---|---|---|---|
| Amount (wt. %) of residue (slack wax and dewaxing aid) | 12.0 | 11.3 | 12.4 | 10.3 |
| Amount (g) of residue (slack wax and dewaxing aid) | 6.25 | 6.5 | 7.2 | 6.0 |

COMPARATIVE EXAMPLE 3

Procedures of Example 2 were repeated in the same manner except that the vacuum distillation of the slack wax was carried out at 350° C. and 1.5 mmHg. Obtained results are shown in Table V, from which it will readily be understood that the dewaxing performance was gradually reduced.

Table V

| Dewaxing Results | First Cycle | Second Cycle | Third Cycle | Fourth Cycle |
|---|---|---|---|---|
| Amount (wt. %) of dewaxing aid | 0.3 | 1.0 | 0.9 | 1.0 |
| Filtration rate (gal/ft$^2$/hr) | 13.8 | 10.5 | 8.6 | 6.2 |
| Yield (wt. %) of dewaxed oil | 79.5 | 78.2 | 75.2 | 73.2 |
| Amount (g) of recovered slack wax | 51.3 | 54.5 | 61.0 | 67.5 |
| Recovery of Dewaxing Aid by Vacuum Distillation | | | | |
| Amount (wt. %) of distilled slack wax | 95.1 | 96.0 | 96.1 | — |
| Amount (wt. %) of residue (slack wax and dewaxing aid) | 4.9 | 4.0 | 3.9 | — |
| Amount (g) of residue (slack wax and dewaxing aid) | 2.5 | 2.2 | 2.4 | — |

What is claimed is:

1. In a solvent dewaxing process wherein a waxy hydrocarbon oil is mixed with solvent and a dewaxing aid comprising a chlorinated paraffin/naphthalene condensate, an alpha-olefin polymer and mixture thereof and wherein the mixture of oil, solvent and dewaxing aid is chilled to form a slurry comprising solid particles of wax containing said dewaxing aid and a mixture of dewaxed oil and solvent and wherein said wax is separated from said dewaxed oil and solvent as a solvent-containing wax cake and wherein solvent is removed from the wax cake to produce substantially solvent-free wax, the improvement which comprises vacuum distilling off most of said solvent-free wax under conditions such that the dewaxing aid therein is not decomposed, said conditions including a temperature no higher than about 320° C., to form a wax bottoms containing said dewaxing aid and recycling said dewaxing aid-containing bottoms back into the dewaxing process wherein it is mixed with said waxy hydrocarbon oil.

2. The process of claim 1 wherein about from 50 to 99.5 wt.% of said wax is distilled off.

3. The process of claim 2 wherein said vacuum distillation is conducted at a pressure no greater than about 100 mmHg.

4. The process of claim 3 wherein said vacuum distillation is conducted at a temperature ranging from about 200° to 300° C.

5. The process of claim 4 wherein said alpha-olefin polymer has a number average molecular weight ranging from about 5,000 to 200,000.

6. The process of claim 5 wherein said filter aid comprises at least about 50 wt.% of said wax bottoms.

7. The process of claim 6 wherein said vacuum distillation is conducted at a pressure ranging from about 1 to 50 mmHg.

8. In a solvent dewaxing process wherein a waxy petroleum oil fraction is mixed with solvent and a dewaxing aid comprising a chlorinated paraffin/naphthalene condensate, an alpha-olefin polymer and mixture thereof and wherein the mixture of oil, solvent and dewaxing aid is chilled to form a slurry comprising dewaxed oil, solvent and solid wax particles containing said dewaxing aid and wherein said wax is separated from said dewaxed oil and solvent as a solvent-containing wax cake and wherein solvent is removed from the wax cake to produce substantially solvent-free wax, the improvement which comprises passing said solvent-free slack wax to a vacuum distillation zone operating at a temperature and pressure no greater than about 320° C. and 100 mmHg, respectively, to distill off from about 50 to 99.5 wt.% of said slack wax to form a wax bottoms in said zone containing said filter aid and recycling at least a portion of said bottoms back into the dewaxing process wherein said recycled bottoms is mixed with the waxy petroleum oil fraction.

9. The process of claim 8 wherein said alpha-olefin polymer has a number average molecular weight ranging from about 5,000 to 200,000.

10. The process of claim 9 wherein said vacuum distillation zone operates at a temperature and pressure ranging from about 200° to 300° C. and 1 to 50 mmHg, respectively.

11. The process of claim 10 wherein from about 85 to 99 wt. % of the wax is distilled off.

12. The process of claim 11 wherein said wax is distilled off to about 5 to 10 wt.% bottoms.

13. The process of claim 7 wherein said vacuum distillation is conducted at a temperature ranging from about 250°-300° C.

14. The process of claim 12 wherein said vacuum distillation is conducted at a temperature ranging from about 250°-300° C.

* * * * *